US005139179A

United States Patent [19]

Cecil

[11] Patent Number: 5,139,179

[45] Date of Patent: Aug. 18, 1992

[54] APPARATUS FOR DISPENSING AND PRESERVING LIQUIDS

[76] Inventor: Kenneth B. Cecil, 25 Knollcrest Rd., Hillsborough, Calif. 94010

[21] Appl. No.: 595,204

[22] Filed: Oct. 9, 1990

[51] Int. Cl.[5] ..... B65D 83/00

[52] U.S. Cl. ..... 222/399; 222/400.7

[58] Field of Search ..... 222/5, 399, 400.7, 152

[56] References Cited

U.S. PATENT DOCUMENTS

| | | | |
|---|---|---|---|
| 1,935,973 | 11/1933 | Altmann | 222/399 |
| 2,705,578 | 4/1955 | Burns | 222/5 |
| 2,805,846 | 9/1957 | Dewan | 222/5 |
| 3,883,043 | 5/1975 | Lane | 222/399 |
| 4,011,971 | 3/1977 | Haydon | 222/399 |
| 4,392,578 | 7/1983 | Fipp et al. | 222/399 |
| 4,473,174 | 9/1984 | Heuser | 222/399 |
| 4,475,576 | 10/1984 | Simon | 141/98 |
| 4,477,477 | 10/1984 | Arter | 141/70 |
| 4,595,121 | 6/1986 | Schultz | 222/399 |
| 4,624,391 | 11/1986 | Shannon | 222/399 |
| 4,691,842 | 9/1987 | Foures | 222/397 |
| 4,702,396 | 10/1987 | Gwiazda | 222/399 |
| 4,706,847 | 11/1987 | Sankey | 222/399 |
| 4,856,680 | 8/1989 | Sitton | 222/397 |
| 4,984,711 | 1/1991 | Ellis | 222/151 |

FOREIGN PATENT DOCUMENTS

| | | | |
|---|---|---|---|
| 3630650 | 11/1987 | Fed. Rep. of Germany | 222/400.7 |
| 1056099 | 10/1953 | France | 222/5 |
| 2219988 | 12/1989 | United Kingdom | 222/5 |

*Primary Examiner*—Michael S. Huppert
*Assistant Examiner*—Kenneth Bomberg
*Attorney, Agent, or Firm*—Thomas M. Freiburger

[57] ABSTRACT

A gas dispensing device uses small liquified gas cartridges having, for example, nitrogen or carbon dioxide, in a hand-held canister unit with a thumb operated valve. In a simple form with an extension tube at its lower end, the device is useful for injecting a blanket of oxygen-devoid gas into a bottle containing a perishable liquid such as wine, so that the partially used bottle of wine can then be recorked and preserved. In this form the device can also be connected to a special closure secured to the mouth of a carbonated beverage, for pressurizing the space above the beverage in the partially used container. In another form, the gas dispenser forms a part of an assembly including a liquid flow tube extending to the bottom of a bottle, a bottle neck seal and a pouring spout, so that the release of gas into the bottle will force the liquid up through the flow tube and out the pouring spout to dispense the liquid.

1 Claim, 3 Drawing Sheets

APPARATUS FOR DISPENSING AND PRESERVING LIQUIDS

BACKGROUND OF THE INVENTION

The invention relates to liquid dispensing apparatus and to apparatus for preserving perishable liquids once opened. More specifically, the invention is concerned with apparatus for dispensing liquid contents from a single bottle, using gas pressure admitted through the neck of the bottle, and to a series of components which may be used for this purpose or separated for use in other purposes.

Devices for driving the contents of a bottle through a dispensing spout, using gas pressure, are known. As a primary example, an apparatus sold under the trademark Cruvinet has been sold for commercial use in bars, restaurants and wine tasting rooms, for dispensing wine from a series of opened wine bottles using $N_2$ gas pressure administered to all of the bottles via a central pressure source. In the Cruvinet apparatus, the centrally dispersed gas is delivered through tubes to each of the bottles, extending through a neck-sealing stopper inserted into each bottle. Pressure from the source is constantly maintained in each of the bottles. On each bottle, the stopper has a valve which can be opened to admit liquid up from a tube which extends to the bottom of the bottle and passes through a second opening in the stopper. At least in theory, the apparatus was capable of keeping liquids such as wines from oxidation after opening, by leaving the stoppers in place and the dispensing gas for the liquid in each bottle, until the next usage.

It is a purpose of the present invention to provide a simplified liquid dispensing apparatus, useful with a single bottle of a product such as wine, and involving a gas dispenser which can be removed and used for other purposes.

SUMMARY OF THE INVENTION

In accordance with this invention, a group of components can be put together to suit several different purposes. A compact gas dispenser, which can be hand held, forms an important component. The gas dispenser comprises a canister for receiving a small cartridge of liquified nitrogen or carbon dioxide, with a gas dispensing tube at the lower end of the canister. Thumb pressure on a valve head at the upper end of the canister releases gas from the internal cartridge and administers the gas through the tube.

In one aspect, the invention essentially comprises a kit of parts, of which the gas dispensing unit forms one part or component. The remaining components of the kit of parts include a dispenser spout accessory configured to be inserted in the top open neck or mouth of a liquid container, such as a wine bottle. The dispenser spout accessory inserts tightly into the bottle neck in the manner of a stopper, sealing against any escape of fluid from the bottle, except through the dispenser spout when desired. An extension tube or liquid flow tube extends centrally from the stopper portion of the dispenser spout accessory down into the bottle, reaching or substantially reaching the bottom of the bottle. This dispenser tube is open, through the accessory, to a liquid pouring spout.

The gas dispenser device may be press fitted onto an exterior gas inlet nipple of the dispenser spout accessory, and when a positive pressure is issued from the gas dispenser through the dispenser spout accessory, the gas flows through a restriction and into the bottle neck, but outside the liquid dispenser tube. This puts a positive pressure on the top of the liquid in the bottle, sufficient to drive some of the liquid up through the dispenser tube and through the liquid pouring spout, to be delivered into a glass or other vessel.

When the gas dispenser device is removed, the nitrogen gas forms a protection layer within the bottle, isolating the liquid surface from the atmosphere. Essentially no exchange of air occurs with the gas lying in a bath on top of the liquid in the bottle, even though an upward channel remains open to the atmosphere (a one-way valve could be included if desired, but it is preferred that pressures be allowed to equalize between the inside and outside of the bottle so that the liquid settles back down from the pouring spout, to the level of the liquid in the bottle). In this way perishable or spoilable liquids such as wine are preserved automatically, with or without removal of the gas dispenser device after use. Although the liquid flow channel remains open from the bottom of the liquid dispenser tube to the spout, gravity retains the liquid in the bottle, and a positive pressure would be required to displace the liquid upwardly.

Therefore, the gas dispensing device can be removed at any time from the dispenser spout accessory in the top of a wine bottle or other container, and used to dispense liquid from another bottle or for other purposes. These other purposes include the use of the gas dispenser to simply preserve a perishable liquid product—for example, a partially consumed wine can be preserved by inserting the gas dispenser into the bottle neck, releasing a bath of gas to displace the air over the wine, then replacing the cork in the bottle.

Another purpose can be to preserve champagne or other carbonated beverages, by administering pressure into a bottle. This involves the use of a different type of bottle stopper, one capable of tightly sealing the bottle neck and allowing a pressurized gas through the stopper, then retained under pressure without escape.

In a second aspect, the invention comprises a single-bottle liquid dispenser of simple and reliable construction. It includes the dispenser spout device which sealingly inserts into the top of a bottle, along with some form of gas injecting implement attached to or attachable to or integral with the dispenser spout device, whether the gas injecting implement has any additional uses or not.

It is therefore among the objects of the present invention to provide a simple, inexpensive and efficiently used liquid dispensing apparatus which can be used with a single bottle, without requiring expensive tubing and cabinetry needed with more elaborate, multiple-bottle dispensing units. A related purpose is to provide such an apparatus which also serves to preserve a perishable liquid in the bottle automatically, even if the pressurized gas source is removed. A further purpose is to provide the liquid dispenser as a component in a kit of parts, at least one part of which can be used for other purposes. These and other objects, advantages and features of the invention will be apparent from the following description of preferred embodiments, considered along with the accompanying drawings.

DESCRIPTION OF PREFERRED EMBODIMENTS

Figure 1:
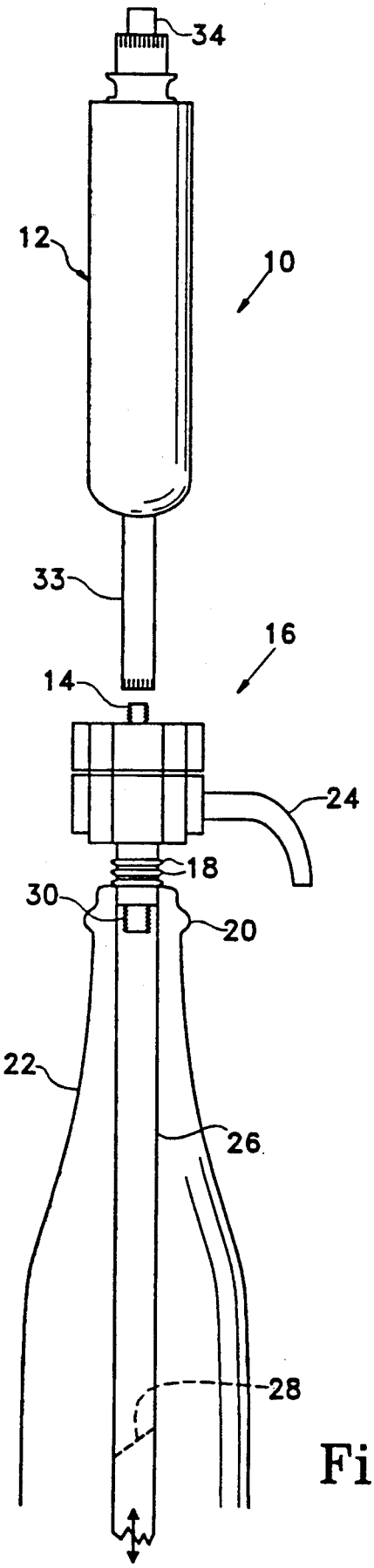
FIG. 1 is an exploded elevation view showing somewhat schematically an assembly of components of a liquid dispensing assembly in accordance with the invention.

In the drawings, FIG. 1 shows a series of components 10 or kit of parts which can be used to form a liquid dispensing apparatus for delivering liquid from a single bottle, or which can be used for other purposes as well.

The assembly of parts shown in FIG. 1 includes a gas dispenser device 12 which, in accordance with the principles of the invention, has multiple uses and forms an important component of the collection of parts 10. The gas dispenser 12 in a preferred embodiment comprises a hand held unit which is constructed as disclosed in U.S. patent application Ser. No. 595,281 entitled "Gas Injector for Preserving Wine and Other Perishable Liquids", filed on the same day as this application and commonly owned with the present invention and application. The disclosure of that copending patent application is hereby incorporated in this application by reference.

Figure 2:
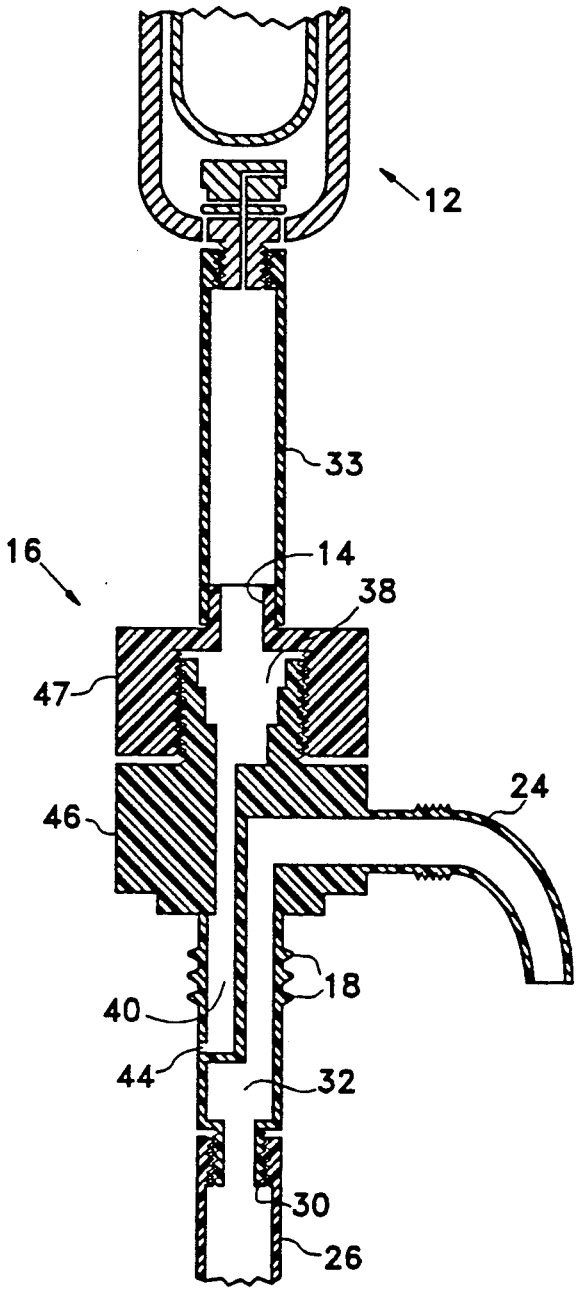
FIG. 2 is a partially exploded sectional view showing a liquid dispenser spout component of the assembly shown in FIG. 1.

As indicated in the exploded view of FIG. 1, and also referring to FIG. 2, the gas dispenser device 12 when used in the assembly shown in FIG. 1 is fitted onto a top nipple 14 of a liquid dispenser spout component or accessory 16. The dispenser spout component has a stopper gasket or series of rings 18 which fit into the open mouth of a bottle neck 20, such as on a wine bottle 22 or other type of bottle of perishable liquid which has been opened and partially consumed.

Figure 3:
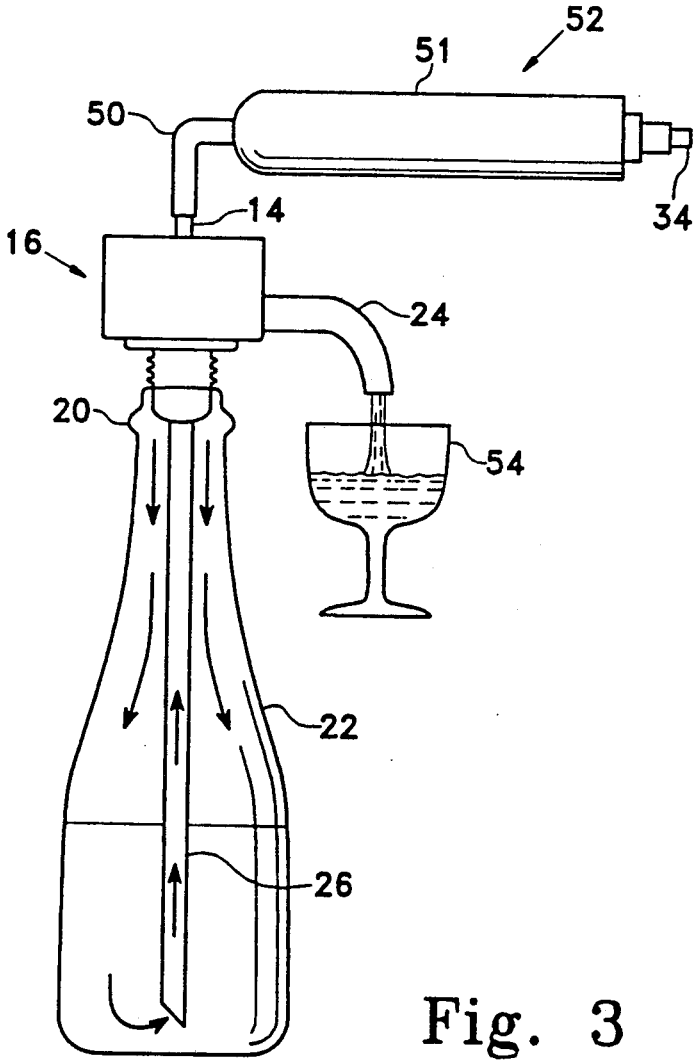
FIG. 3 is a view somewhat similar to FIG. 1, showing the liquid dispenser apparatus assembled in a bottle, with a somewhat different configuration.

The dispenser spout component 16 has an exterior pouring spout 24 and an extension tube or liquid flow tube 26 which extends down into the bottle 22 to an appropriate distance, reaching or substantially reaching the bottom of the bottle so as to dispense liquid therefrom. It may be cut as indicated by dashed lines 28 to extend the correct distance for a particular bottle. This extension tube, preferably a relatively soft, food grade inert plastic tube, is slipped over a collar or nipple 30 at the bottom of the dispenser component 16, as indicated in FIGS. 1, 2 and 3. In this way the tube 26 has direct communication with the pouring spout 24, which can be seen from the sectional view of FIG. 2. An internal liquid channel 32 provides this direct and preferably continuous communication.

When liquid is to be dispensed through the pouring spout 24 of the liquid dispenser component 16, the gas dispensing unit 12 is placed onto the nipple 14 via a tubular extension 33, in a press fit, gas tight engagement. Pressurized ga is released from the unit 12 by thumb pressure on a spring-loaded valve 34 at the top of the unit 12. This gas passes through the liquid dispenser accessory 16, through an upper inlet 38, down through a gas channel 40 which is alongside the separate channel 32 for the liquid, and then out of the liquid dispensing component 16 through an exit orifice 44 which allows the gas to enter the bottle without passing through the downwardly extending liquid dispenser tube 26.

As can be seen from FIG. 2, the exit orifice 44 of the dispenser component 16 preferably comprises a restriction, which may be a narrow slit, helping to prevent the outward flow of gas from the bottle and likewise preventing exchange between the gas in the bottle and the atmosphere, when the gas dispensing unit 12 is not connected to the liquid dispensing component 16. This is sufficient to prevent exchange of gas, since nitrogen gas is approximately the same weight as oxygen and air, and displacement of the nitrogen bath in the bottle would have to be deliberate or under unusual circumstances. This leaves the dispenser component 16 open through the gas channel 40, allowing liquid to settle back down the tube 26 after usage (and removal of the gas dispenser 12), to the level of liquid in the bottle. In this process some nitrogen is pushed back out of the gas channel 40, but no air enters through the gas channel.

As FIG. 2 illustrates, the dispenser spout component 16 can include a main body component 46 and a screwed on cap component 47, both preferably formed of a high quality food grade plastic (although metal could be used). The pouring spout 24 can be formed integrally with the body 46 or it can be assembled onto the body.

Thus, the assembly of components 10 shown in FIG. 1 can be very conveniently used as a single-bottle liquid dispenser. Although the dispensing apparatus can be used for a number of different types of perishable liquids, a primary use of the dispensing apparatus is for wines, some of which can be very susceptible to oxidation after once being opened. The single bottle dispensing apparatus serves to permit convenient dispensing of portions of the wine into glasses, while having the concurrent benefit of leaving a bath of substantially oxygen-devoid gas lying over the liquid. This bath of gas, preferably nitrogen or carbon dioxide, preserves the liquid against oxidation for a considerable period of time, and there is no need to reinsert a cork or other closure. After dispensing the wine or other liquid, the user can simply pull the gas dispensing unit 12 off the nipple 14, then put the gas dispenser away, use it for another bottle of wine having a liquid dispenser component 16 in its neck, or use it for another purpose such as a simple liquid preserving device or a carbonated beverage preserving device, as further explained below.

FIG. 3 schematically illustrates that the assembly of components 10 can be configured slightly differently for meeting space requirements or to address other logistical concerns of its use. The tubular extension 33 of the gas dispensing unit 12 shown in FIG. 1 can be unscrewed and replaced with an L-shaped tube 50 as shown in FIG. 3. Although threads are preferred for the connection of these tubes (33 or 50) to the gas dispenser unit, as shown in the above referenced copending application, a press fit connection can also be used, particularly since only very low gauge pressures are involved (the pressure required to raise a liquid only about one foot). Thus, the L-shaped tube 50 shown in FIG. 3 could be press fit onto the body or canister 51 of the gas dispenser unit 52, as well as press fit onto the nipple 14 of the liquid delivering unit 16, if desired. The principal concern regarding these connections is that, in one preferred embodiment, they enable the user to quickly and conveniently move the gas dispenser unit 12 or 52 from one use to another, i.e. from use as a part of the liquid dispenser to other uses mentioned above and further described below.

FIG. 3 also illustrates the flow of gas from the dispenser unit 52 through the dispenser spout component 16 into the bottle 22, causing flow of liquid up the flow tube 26, out the pouring spout 24 and into a glass 54. Some wine bottles have a strongly arched interior bottom surface, and in that case the flexible liquid flow tube 26 can be pushed over to one side so its lower end resides at the deepest part of the bottle. The length of the tube can be cut accordingly.

Figure 4:
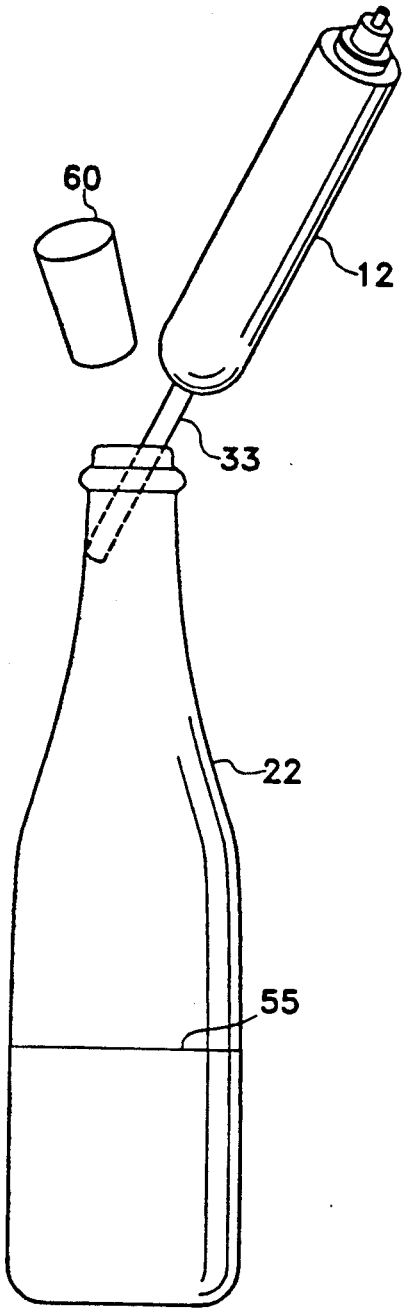
FIG. 4 is a view showing a gas dispensing device, which forms a component of the liquid dispensing apparatus of FIGS. 1 and 3, being used separately for the purpose of preserving liquid in a bottle.

FIG. 4 shows one of the further uses of the gas dispenser unit 12 alone. In FIG. 4 the hand held device 12 is used to preserve a partially consumed bottle of liquid such as a perishable wine. The elongated tubular extension 33 is the preferred extension for service as a simple liquid preserver, so that the gas (preferably nitrogen but alternatively carbon dioxide) is injected from a point as far down into the bottle neck as is practicable. This helps assure that the injected gas acts to purge the air from the bottle, by delivering the gas down against the liquid surface 55, driving the air upwardly and out of the bottle neck. When a dosage of gas has been administered into the bottle, the cork 60 (or other closure such as a screw cap) can be replaced on the bottle 22.

Figure 5:
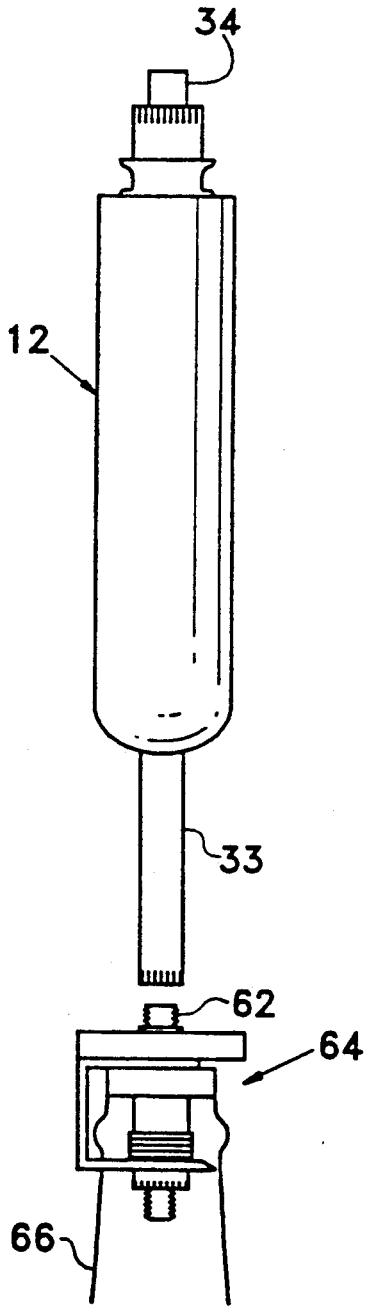
FIG. 5 is a view showing the gas dispensing device used for the further purpose of preserving a carbonated beverage.
Figure 6:
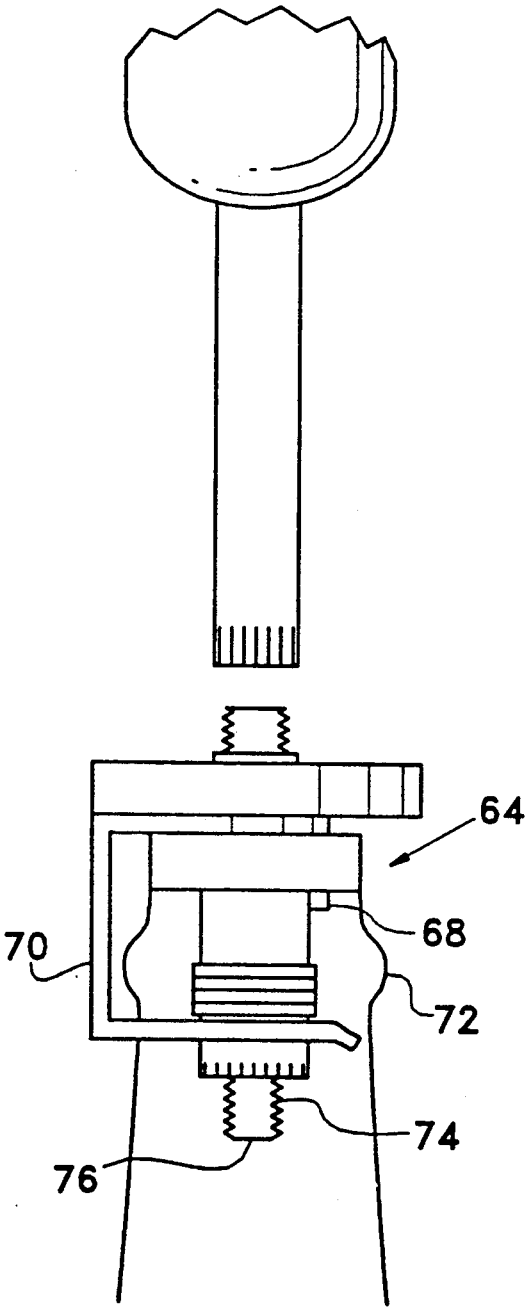
FIG. 6 is a detail view indicating in greater detail the construction of a stopper valve for use with the bottle of carbonated beverage shown in FIG. 5.

FIGS. 5 and 6 illustrate another optional use of the gas dispenser 12 shown in FIGS. 1 and 4. In this procedure the gas dispenser unit is used for preserving the effervescence and freshness of a carbonated beverage such as champagne or a soft drink. As FIG. 5 indicates, the extension stem or tube 33 of the hand held gas dispenser device 12 is pressed down over a nipple 62 of a stopper valve unit 64. A sealed connection is made, then pressurized gas is dispensed by pressing the thumb button 34 of the gas unit. The gas enters the bottle 66 under pressure, and remains under pressure in the bottle due to the presence of a one-way valve in the unit 64.

FIG. 6 shows the stopper valve unit 64 in greater detail, indicating that a sealing gasket or collar 68 resides inside the neck of the bottle. A gripper device 70 preferably is provided, to slip under a bead 72 on the outside of the bottle neck, for retaining the stopper valve unit 64 in place even under considerable pressure such as may be present with champagne. The one-way valve may comprise a simple neoprene rubber bulb valve member having a nipple 74 with a pinhole outlet at 76. Pressure from the gas dispenser device 12, pushing down through the unit 64, expands the bulb and opens the pinhole for the gas to pass into the bottle. Pressure in the reverse direction, contained in the bottle, tends to more tightly close the pinhole.

Although terms such as "upper" and "lower", "above" and "below", etc. are used herein and in the claims, it should be understood that other orientations and physical arrangements are possible. These terms are merely used for convenient reference to the embodiments as illustrated, and not to be limiting.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A set of components useful for preserving liquids and for dispensing a liquid from a bottle having a neck while also preserving the liquid remaining in the bottle, comprising, (a) a dispenser spout component comprising:

stopper means for connection to the neck of a bottle in sealed relationship, a liquid pouring spout extending to the exterior of the dispenser spout component end of the bottle, liquid flow tube means for extending downwardly into the bottle and extending generally to the bottom of the bottle, internal liquid channel means in the dispenser spout component for connecting the liquid flow tube means to the liquid pouring spout, a gas receiving nipple on the exterior of the dispenser spout component, and internal gas conduit means for communicating gas from the gas nipple down into the bottle;

(b) a hand-held gas dispensing device having a canister with an internal cavity for receiving a cartridge of a pressurized liquified gas substantially devoid of oxygen, a tubular member at an outlet end of the canister and external push button valve means for releasing gas from the cartridge through the tubular member when the push button means is engaged by a user; and (c) connection means with quick-disconnect means for sealingly securing a lower end of the tubular member to the gas receiving nipple at the exterior of the dispenser spout component, (d) a carbonated beverage bottle stopper connection, comprising neck connection means for connection to the neck of a carbonated beverage bottle in sealed, pressure-tight relationship, a gas receiving nipple on the exterior of the neck connection means, and internal gas conduit means connected to the gas nipple and extending to a lower position internal to the bottle, with the internal gas conduit means including one-way valve means for allowing pressurized gas to enter the nipple and to pass through the gas conduit means, whereby the hand-held gas dispensing device may be connected to the nipple of the dispenser spout component to deliver gas through the dispenser spout component and into a bottle to which the component is secured, in order to deliver liquid from the bottle out through the liquid pouring spout, and whereby the hand-held gas dispensing device can be used to preserve a carbonated beverage by connection to the nipple of the carbonated beverage bottle stopper connection as secured in the neck of a carbonated beverage bottle, by dispensing pressurized gas into the carbonated beverage bottle.

* * * * *